US012752958B1

(12) United States Patent
Philips

(10) Patent No.: US 12,752,958 B1
(45) Date of Patent: Oct. 6, 2026

(54) LEAK-RESISTANT CONTAINER WITH REINFORCED CORNERS

(71) Applicant: Packaging Corporation of America, Lake Forest, IL (US)

(72) Inventor: Nicholas A. Philips, Sugar Grove, IL (US)

(73) Assignee: Packaging Corporation of America, Lake Forest, IL (US)

( * ) Notice: Subject to any disclaimer, the term of this patent is extended or adjusted under 35 U.S.C. 154(b) by 94 days.

(21) Appl. No.: 18/823,493

(22) Filed: Sep. 3, 2024

Related U.S. Application Data

(60) Provisional application No. 63/581,200, filed on Sep. 7, 2023.

(51) Int. Cl.
*B65D 5/44* (2006.01)
*B65D 5/20* (2006.01)
*B65D 5/56* (2006.01)

(52) U.S. Cl.
CPC ..... *B65D 5/443* (2013.01); *B65D 5/20* (2013.01); *B65D 5/56* (2013.01)

(58) Field of Classification Search
CPC . B65D 5/443; B65D 5/20; B65D 5/56; B65D 5/248; B65D 5/241; B65D 5/4266; B65D 5/002; B65D 5/22; B65D 5/28; B65D 11/16; B65D 11/24; B65D 5/2076; B65D 5/3607; B65D 5/3642; B65D 5/3657; B65D 5/4279
USPC ..... 229/165, 186, 169, 170, 172, 191, 918, 229/919, 939, 122.32, 132, 167, 174, 176, 229/920, 930, 931
See application file for complete search history.

(56) References Cited

U.S. PATENT DOCUMENTS

| | | | | |
|---|---|---|---|---|
| 1,653,116 A | | 12/1927 | Parks | |
| 3,199,763 A | * | 8/1965 | Anderson | B65D 5/4266 229/126 |
| 3,254,823 A | | 6/1966 | Shina | |
| 5,002,224 A | | 3/1991 | Muise | |
| 5,535,941 A | | 7/1996 | Garza | |
| 7,487,905 B2 | | 2/2009 | McClure | |
| 12,448,171 B2 | * | 10/2025 | Sollie | B65D 5/60 |

FOREIGN PATENT DOCUMENTS

| | | | | |
|---|---|---|---|---|
| EP | 2566766 B1 | * | 6/2014 | B65D 5/443 |
| EP | 3115310 B1 | * | 9/2017 | B65D 5/4608 |
| FR | 2236738 A | * | 3/1975 | |

* cited by examiner

*Primary Examiner* — Christopher R Demeree
(74) *Attorney, Agent, or Firm* — Klarquist Sparkman, LLP

(57) ABSTRACT

Containers that include leak-resistant, reinforced corner structures with webs between the side walls and the end walls can include a bottom panel, first and second side wall panels, and first and second end wall panels. A reinforced corner structure can include a corner flange coupled to the first side wall panel and to the first end wall panel. The corner flange includes a web coupled to the first end wall panel along a first fold line and coupled to the corner flange along a second fold line, and the web is positioned between the first end wall panel and the corner flange when the container is in an erected state. The container is made from a corrugated paperboard material, and flutes of the corrugated paperboard material are crushed in the web.

25 Claims, 11 Drawing Sheets

LEAK-RESISTANT CONTAINER WITH REINFORCED CORNERS

CROSS REFERENCE TO RELATED APPLICATION

The present application claims the benefit of U.S. Provisional Application No. 63/581,200, filed Sep. 7, 2023, which is incorporated herein by reference in its entirety.

FIELD

The present disclosure pertains to one-piece, leak-resistant containers that include leak-resistant, reinforced corner structures.

BACKGROUND

In many applications, corrugated paperboard containers for use with agricultural or meat products must have some degree of leak resistance, and must also be capable of being stacked in a loaded state without collapsing. However, many existing leak-resistant containers must be assembled from multiple blanks, which complicates the assembly process and the associated machinery. Additionally, many existing containers are leak resistant to only a relatively low height within the container, limiting the depth of liquid that can be contained in the container. Accordingly, there exists a need for improvements to leak-resistant containers.

SUMMARY

Certain examples of the disclosure pertain to leak-resistant containers that include leak-resistant, reinforced corner structures with webs between the side walls and the end walls. In a representative example, a container comprises a bottom panel forming a container bottom; a first side wall panel coupled to the bottom panel and forming a first side wall of the container; a second side wall panel coupled to the bottom panel and forming a second side wall of the container; a first end wall panel coupled to the bottom panel and forming a first end wall of the container; a second end wall panel coupled to the bottom panel and forming a second end wall of the container; and a reinforced corner structure comprising a corner flange coupled to the first side wall panel and to the first end wall panel; wherein the corner flange comprises a web coupled to the first end wall panel along a first fold line and coupled to the corner flange along a second fold line, and wherein the web is positioned between the first end wall panel and the corner flange when the container is in an erected state; and wherein the container comprises a corrugated paperboard material, and flutes of the corrugated paperboard material are crushed in the web.

In any or all of the disclosed embodiments, the corner flange further comprises a cut or perforation that is collinear with the second fold line.

In any or all of the disclosed embodiments, the cut or perforation is above the container bottom.

In any or all of the disclosed embodiments, the web comprises a free upper edge that is located between the first end wall panel and the corner flange.

In any or all of the disclosed embodiments, the container further comprises a reinforcement flap coupled to the corner flange.

In any or all of the disclosed embodiments, the reinforcement flap comprises two reinforcement panels or three reinforcement panels.

In any or all of the disclosed embodiments, the reinforcement flap is adhered to the corner flange above the web and the corner flange is free of adhesive below a free upper edge of the web.

In any or all of the disclosed embodiments, the container further comprises a first top flap coupled to the first side wall panel and a second top flap coupled to the second side wall panel.

In any or all of the disclosed embodiments, the first fold line comprises a relief cut.

In any or all of the disclosed embodiments, the second fold line of the web extends diagonally across the corner flange at an angle to the first fold line of 30° to 60°.

In any or all of the disclosed embodiments, an end wall panel—reinforcement flap cut separates the first end wall panel from the reinforcement flap, and the first fold line coupling the web to the first end wall panel and the end wall panel—reinforcement flap cut are offset from each other such that the first fold line and the end wall panel—reinforcement flap cut are not co-linear.

In another representative example, container blank comprises a bottom panel for forming a container bottom; a first side wall panel coupled to the bottom panel; a second side wall panel coupled to the bottom panel on the opposite side of the bottom panel from the first side wall panel; a first end wall panel coupled to the bottom panel; a second end wall panel coupled to the bottom panel on the opposite side of the bottom panel from the first end wall panel; a reinforced corner structure comprising a corner flange coupled to the first side wall panel and to the first end wall panel; wherein the corner flange comprises a web coupled to the first end wall panel along a first fold line and coupled to the corner flange along a second fold line, and wherein the web is positionable between the first end wall panel and the corner flange when the container blank is erected into a container; and wherein the container blank comprises a corrugated paperboard material, and flutes of the corrugated paperboard material are crushed in the web.

In any or all of the disclosed embodiments, the corner flange further comprises a cut or perforation that is collinear with the second fold line.

In any or all of the disclosed embodiments, the cut or perforation is spaced apart from the first fold line in a direction of flutes of the corrugated paperboard material.

In any or all of the disclosed embodiments, the container blank further comprises a reinforcement flap coupled to the corner flange.

In any or all of the disclosed embodiments, the web comprises a free edge that is located between the reinforcement flap and the corner flange.

In any or all of the disclosed embodiments, the free edge of the web is defined by a cut, and the reinforcement flap comprises a third fold line that is collinear with the cut defining the free edge.

In any or all of the disclosed embodiments, the reinforcement flap comprises two reinforcement panels or three reinforcement panels.

In any or all of the disclosed embodiments, an end wall panel—reinforcement flap cut separates the first end wall panel from the reinforcement flap, and the first fold line coupling the web to the first end wall panel and the end wall panel—reinforcement flap cut are offset from each other such that the first fold line and the end wall panel—reinforcement flap cut are not collinear.

In any or all of the disclosed embodiments, the reinforcement flap extends outwardly beyond the first end wall panel.

In any or all of the disclosed embodiments, the container blank further comprises a first top flap coupled to the first side wall panel and a second top flap coupled to the second side wall panel.

In any or all of the disclosed embodiments, the second fold line of the web extends diagonally across the corner flange at an angle to the first fold line of 30° to 60°.

In any or all of the disclosed embodiments, a container blank comprises a bottom panel for forming a container bottom; a first side wall panel coupled to the bottom panel; a second side wall panel coupled to the bottom panel on the opposite side of the bottom panel from the first side wall panel; a first end wall panel coupled to the bottom panel; a second end wall panel coupled to the bottom panel on the opposite side of the bottom panel from the first end wall panel; a reinforced corner structure comprising a corner flange coupled to the first side wall panel and to the first end wall panel, and a reinforcement flap coupled to the corner flange such that the corner flange is between the first side wall panel and the reinforcement flap; wherein the corner flange comprises a web coupled to the first end wall panel along a first fold line and coupled to the corner flange along a second fold line, and wherein the web is positionable between the first end wall panel and the corner flange when the container blank is erected into a container; and wherein an end wall panel—reinforcement flap cut separates the first end wall panel from the reinforcement flap, and the first fold line and the end wall panel—reinforcement flap cut are offset from each other such that the first fold line and the end wall panel—reinforcement flap cut are not collinear.

In any or all of the disclosed embodiments, the web comprises a free edge that is located between the reinforcement flap and the corner flange, the free edge of the web being defined by a cut, and the reinforcement flap comprising a third fold line that is collinear with the cut defining the free edge.

In any or all of the disclosed embodiments, the reinforcement flap extends outwardly beyond the first end wall panel.

The foregoing and other objects, features, and advantages of the present disclosure will become more apparent from the following detailed description, which proceeds with reference to the accompanying figures.

DETAILED DESCRIPTION

Explanation of Terms

Figure 1:
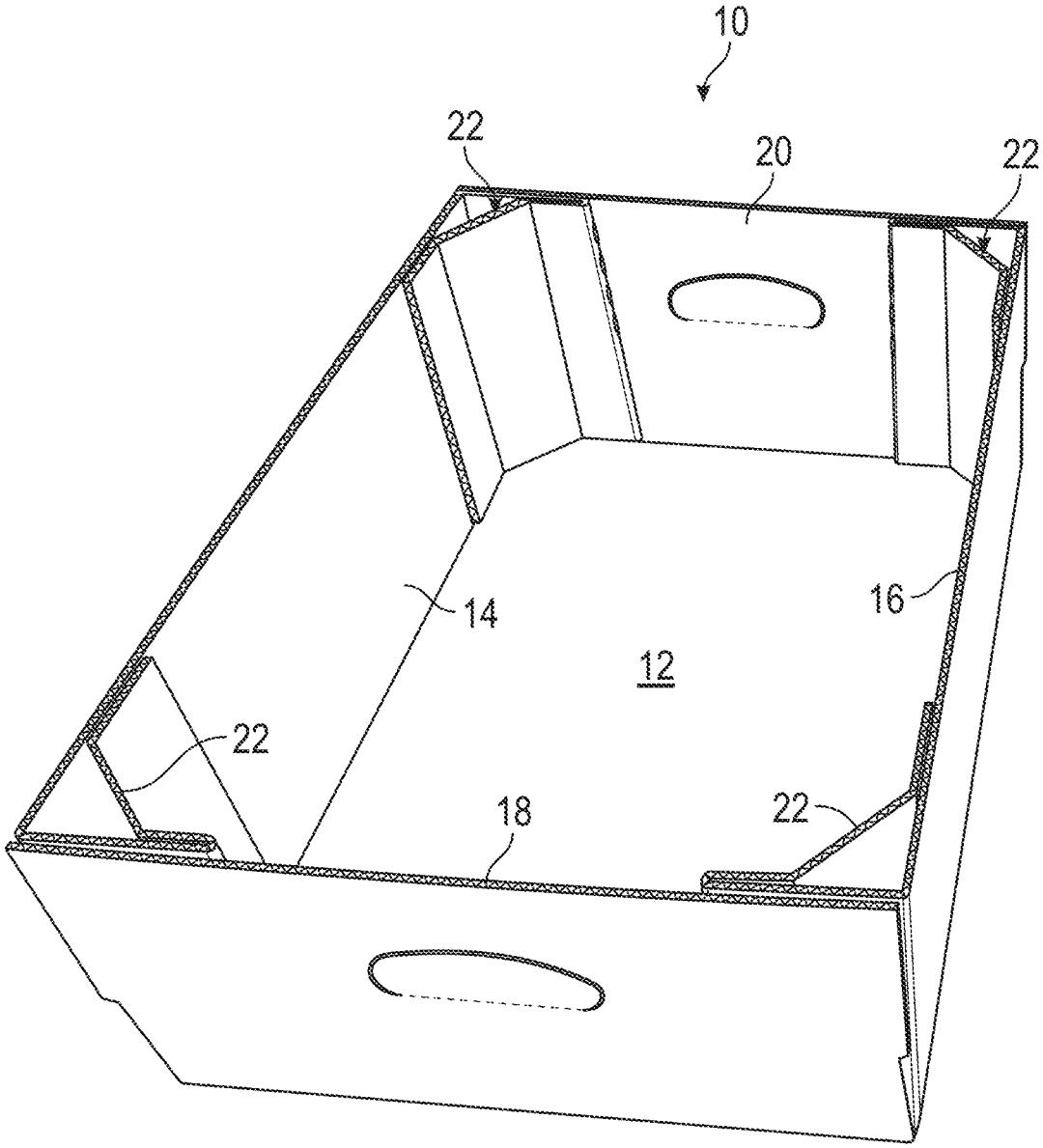
FIG. 1 illustrates a representative example of a container including leak-resistant, reinforced corner structures in the form of corner posts.

For purposes of this description, certain aspects, advantages, and novel features of the embodiments of this disclosure are described herein. The disclosed methods, apparatus, and systems should not be construed as being limiting in any way. Instead, the present disclosure is directed toward all novel and nonobvious features and aspects of the various disclosed embodiments, alone and in various combinations and sub-combinations with one another. The methods, apparatus, and systems are not limited to any specific aspect or feature or combination thereof, nor do the disclosed embodiments require that any one or more specific advantages be present or problems be solved.

Although the operations of some of the disclosed embodiments are described in a particular, sequential order for convenient presentation, it should be understood that this manner of description encompasses rearrangement, unless a particular ordering is required by specific language set forth herein. For example, operations described sequentially may in some cases be rearranged or performed concurrently. Moreover, for the sake of simplicity, the attached figures may not show the various ways in which the disclosed methods can be used in conjunction with other methods.

As used in this disclosure and in the claims, the singular forms "a," "an," and "the" include the plural forms unless the context clearly dictates otherwise. Additionally, the term "includes" means "comprises." Further, the terms "coupled" and "associated" generally mean electrically, electromagnetically, and/or physically (e.g., mechanically or chemically) coupled or linked and does not exclude the presence of intermediate elements between the coupled or associated items absent specific contrary language.

In some examples, values, procedures, or apparatus may be referred to as "lowest," "best," "minimum," or the like. It will be appreciated that such descriptions are intended to indicate that a selection among many alternatives can be made, and such selections need not be better, smaller, or otherwise preferable to other selections.

In the description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Unless otherwise indicated, all numbers expressing dimensions and so forth as used in the specification or claims are to be understood as being modified by the term "about." Accordingly, unless otherwise indicated, implicitly or explicitly, the numerical parameters set forth are approximations that can depend on the desired properties sought and/or limits of detection under test conditions/methods familiar to those of ordinary skill in the art. When directly and explicitly distinguishing embodiments from discussed prior art, the embodiment numbers are not approximates unless the word "about" is recited.

Although there are alternatives for various components, dimensions, parameters, operating conditions, etc., set forth herein, that does not mean that those alternatives are necessarily equivalent and/or perform equally well. Nor does it mean that the alternatives are listed in a preferred order unless stated otherwise.

As used herein, values modified by the term "substantially" mean+10% of the stated value. The term "substantially parallel" means an angle of ±100 between an object and a reference. In another example, the term "substantially perpendicular" means an angle of 80° to 100° between an object and a reference.

Overview of the Disclosed Technology

The present disclosure pertains to containers capable of holding liquid or moisture-saturated contents, such as agricultural or meat products. The containers can be leak-resistant up to a specified height measured from the bottom of the container. The specified height of leak resistance can be increased or decreased according to user specifications by adjusting the configuration of certain adjustable features of the container blank. The containers can also have a reinforced corner structure, which provides improved stacking strength. Advantageously, the containers can also be formed from a single container blank. This can significantly simplify the process and the machinery for erecting the container as compared to existing leak-resistant containers, which typically include multiple separate blanks that must be erected and assembled together.

Example 1: Leak-Resistant Containers with Reinforced Corners

FIG. 1 illustrates a representative example of a container 10 including a container bottom 12, a first side wall 14, a second side wall 16, a first end wall 18, and a second end wall 20. The container 10 includes reinforced corner structures 22 (also referred to as "delta corners," "corner posts" or "closed corners") in each corner of the container. The configuration of the reinforced corner structures provides improved stacking strength and leak resistance.

The illustrated container 10 can be made of a variety of materials. However, in certain examples the container 10 can be made from corrugated paperboard material having a corrugated layer (also referred to as a "fluted medium layer" and a "fluted layer") between two face sheets (also referred to as "liners" or "liner layers").

Figure 2:
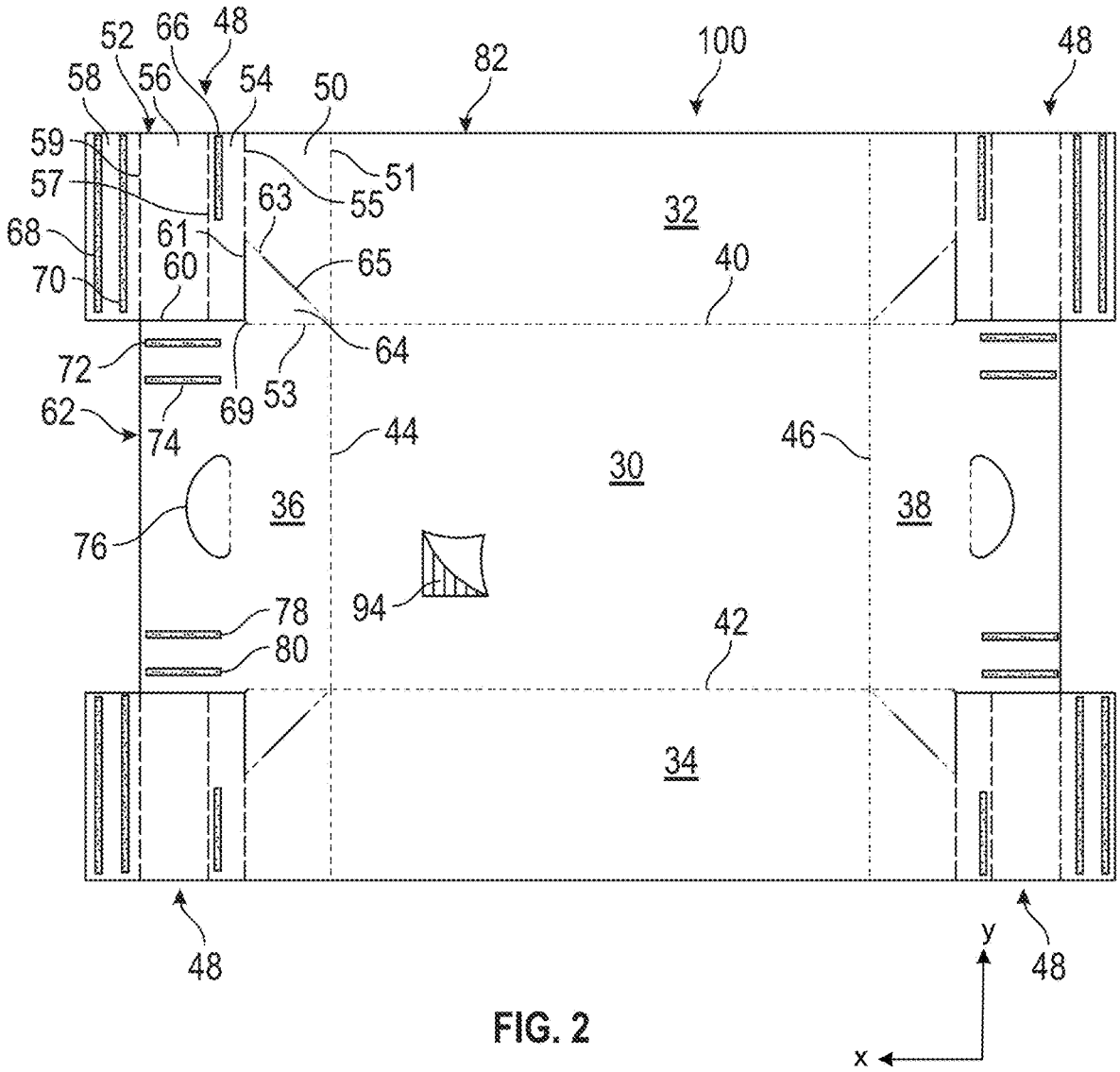
FIG. 2 illustrates a blank from which the container of FIG. 1 can be erected.

Referring to FIG. 2, the container 10 can be erected from a flat, one-piece (unitary) blank 100. In FIG. 2, fold lines are represented as dashed lines. Fold lines are lines of weakness between connected panels that allow the panels to be folded relative to each other. Examples of fold lines can include creases formed in the corrugated board, scores (e.g., partial-depth cuts that extend through one liner layer of the corrugated board but not through the corrugated layer beneath it), perforations, and combinations thereof. For example, a fold line can include a crease as well as perforations along the crease. Fold lines including perforations are represented by dashes of increased length. Perforations can be relatively short cuts that extend all the way through the thickness of the corrugated material. The edges of the blank, along with cuts in panels and cuts between panels (also referred to as "slits"), are represented as solid lines. Unless indicated otherwise, cuts and slits are through the entire thickness of the material. A coordinate axis is indicated in the lower right corner of FIG. 2. In examples in which the container 10 is made from corrugated board, the flutes of the fluted medium layer can extend parallel or substantially parallel to the y-axis, although in other examples the flutes can extend along the x-axis. A small section of the flutes 94 is illustrated on panel 30 in FIG. 2.

The blank 100 can comprise a main panel referred to hereinafter as a bottom panel 30. A plurality of wall panels are coupled to the bottom panel 30, including a first side wall panel 32, a second side wall panel 34, a first end wall panel 36, and a second end wall panel 38. The first side wall panel 32 is coupled to the bottom panel 30 at a fold line 40. The second side wall 34 panel is coupled to the bottom panel 30 at a fold line 42. The first and second end walls 36 and 38 are coupled to the bottom panel 30 at respective fold lines 44 and 46.

The blank 100 can comprise reinforced corner portions generally indicated at 48. In the illustrated configuration, each corner of the blank includes a reinforced corner portion 48, although in other examples one, two, or three corners of the blank can include reinforced corner portions 48. Referring to the upper left corner portion 48 for purposes of illustration, the corner portions can include a corner flange 50 and a reinforcement flap 52. At the upper left corner of the blank, the corner flange 50 can be coupled to the left edge of the first side wall panel 32 at a fold line 51, which can be collinear with the fold line 44. The corner flange 50 can be coupled to the first end wall panel 36 at a fold line 53 (also referred to as a "first fold line") along the lower edge of the corner flange 50.

The reinforcement flap 52 can be coupled to the corner flange 50 along a fold line 55 (which can be a perforated fold line, and which is also referred to as a "third fold line"). The reinforcement flap 52 can be divided into three distinct reinforcement panels 54, 56, and 58 by fold lines (e.g., perforated fold lines) 57 and 59. A cut 60 (also referred to as an "end wall panel reinforcement flap cut") can extend from the outer edge 62 of the first end wall panel 36 (the upper edge in the erected container) to the corner flange 50. The cut 60 can separate the first end wall panel 36 from the reinforcement flap 52.

The corner flange 50 can comprise a web 64 of material that couples the corner flange 50 to the first end wall panel 36. The web 64 can be defined by a cut 61 extending from the first end wall panel 36 along a portion of the fold line 55 in the direction of the y-axis. A fold line 63 (also referred to as a "second fold line") can extend diagonally across a portion of the corner flange 50 at an angle to the x-axis, and/or to the first fold line 53 of, for example, 30° to 60°, such as 45°. The fold line 63 can include a collinear cut 65. The cut 65 can be in a central, lower portion of the corner flange 50. The cut 65 can have any length and can be located anywhere along the fold line 63. The web 64 can be coupled to the main body of the corner flange 50 by the portion of the fold line 63 above the cut 65 and the portion of the fold line 63 below the cut 65. The web 64 can also be coupled to the first end wall panel 36 along the fold line 53 as noted above. A short relief cut 69 can extend from the junction of the cut 60 and the cut 61 to the fold line 53 at an angle to the x-axis (e.g., 30° to 60°, such as 45°).

The web 64 can thus have a triangular shape with a height corresponding to the length of the cut 61 along the y-axis. In certain examples, the flutes in the web 64 can be crushed. This can reduce the thickness of the web 64 and thus can limit buckling of the corner flange 50 when the container is erected as further described below. In other examples, the flutes need not be crushed in the web 64 depending upon, for example, the thickness and/or stiffness of the corrugated material.

Before the container is erected, lines or "beads" of adhesive can be applied to the blank 100 at various locations. For example, still referring to FIG. 2 an adhesive bead 66 can be applied to the reinforcement panel 54 along the direction of the y-axis adjacent the fold line 57. The adhesive bead 66 can extend from at or adjacent an upper edge 82 of the blank downwardly along the y-axis, but can stop short of the upper end of the cut 61. Stated differently, in the illustrated example the cut 61 and the adhesive bead 66 do not overlap in the y-direction (e.g., in the direction of the flutes). Two adhesive beads 68 and 70 can be applied to the reinforcement panel 58 extending in the direction of the y-axis. Two adhesive beads 72 and 74 can be applied to the first end wall panel 36 on one side of the handhold 76, and two adhesive beads 78 and 80 can be applied to the first end wall panel 36 on the other side of the handhold 76. The adhesive beads 72, 74, 78, and 80 can extend inwardly along the x-axis from at or adjacent the edge 62 of the first end wall panel 36.

In the illustrated configuration, each of the other three corners of the blank 100 includes a reinforced corner portion configured similarly to the reinforced corner portion 48 described above.

Figure 3:
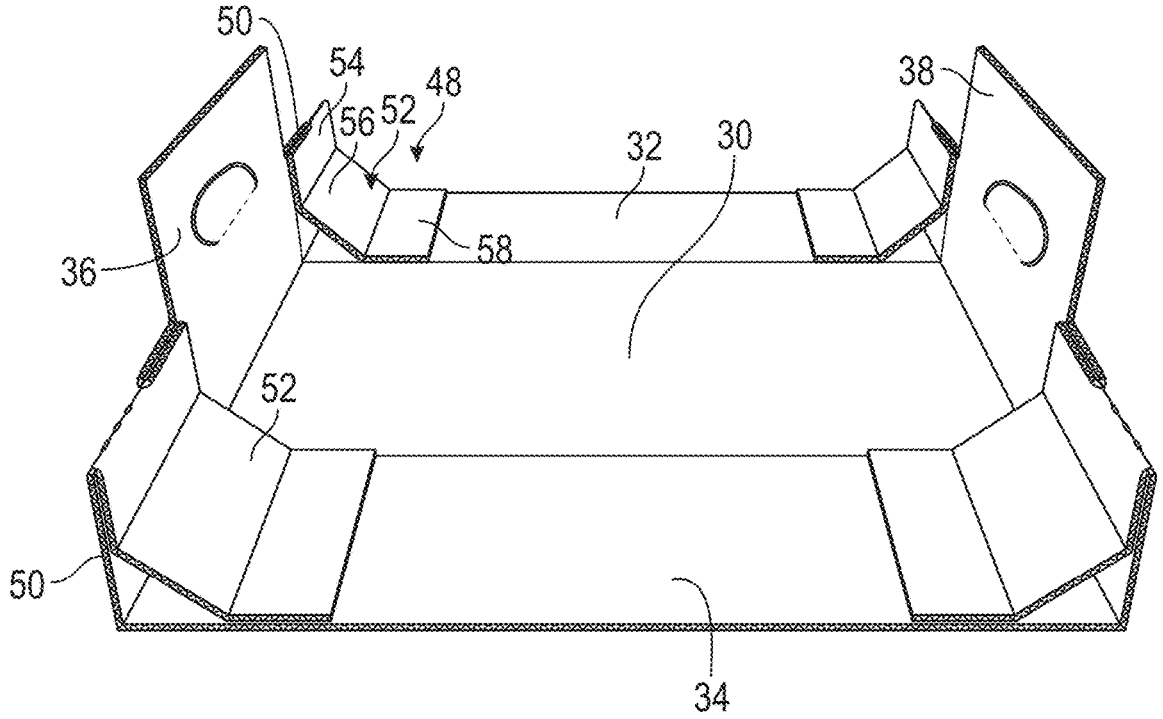
FIGS. 3 and 4 are perspective views of intermediate states of the container of FIG. 1 during assembly.
Figure 4:
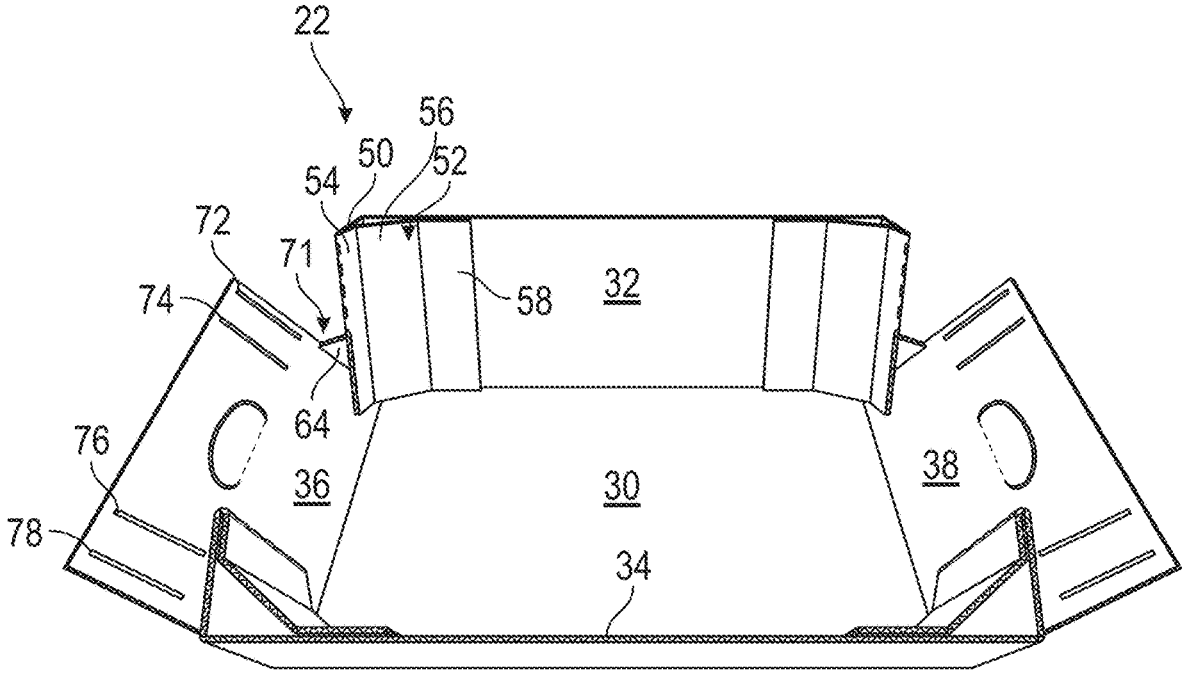

FIGS. 3 and 4 illustrate intermediate states of the blank 100 as it is formed into the container 10. In FIG. 3 the first and second end wall panels 36, 38 and the associated corner flanges 50 on both sides of the end wall panels are folded upwardly. The reinforcement flaps 52 are folded over about the fold lines 55 and the reinforcement panels 58 are adhered to the inside surfaces of the first and second side wall panels 32 and 34. Referring to FIG. 4, the first and second side wall panels 32 and 34 are then folded upwardly about the fold lines 40 and 42. During this operation the web 64 in each corner pivots about the fold lines 53 and 63 (FIG. 2) and is positioned between the respective end wall panel (e.g., panel 36) and the corner flange 50 to form the reinforced corner structures 22. Referring to the corner structure 22 at the upper left in FIG. 4, the edge of the web 64 at the location of the cut 61 (FIG. 2) becomes an upper free edge 71 of the web (FIG. 4). The first end wall panel 36, the web 64, and the corner flange 50 thus form a triple layer on the associated side of the corner structure at the bottom of the container. The reinforcement panel 54 is adhered to the inner surface of the corner flange 50 by the adhesive bead 66 without impeding motion of the web 64. The first end wall panel 36 is adhered to the outer surface of the corner flange 50 by the adhesive beads 72 and 74, also without impeding motion of the web 64. The corner flange 50 can thus be free of adhesive below the free upper edge 71 of the web 64. Similar operations are performed at the other corners. The resulting corner structure 22 (FIG. 1) thus provides a corner that is formed of continuous corrugated material including portions of the bottom panel 30, the first side wall panel 32, the first end wall panel 36, and the web 64. That is, the corner is free of cuts in the corrugated material up to the level of the cut 65 of the web 64. The fully assembled container is shown in FIG. 1.

Containers including the reinforced corner structures 22 disclosed herein can provide a number of significant advantages. For example, the continuous material at the corner provides a barrier to leakage, making the container leak-resistant up to at least the height of the lower end of the cut 65 of the web 64. The container can also be erected from a one-piece blank; many existing leak-resistant containers are assembled from two blanks, three blanks, or more, which complicates assembly.

The length and/or location of the cut 65 of the web 64, and thus the depth of liquid that can be contained in the container, can also be adjusted. For example, adjusting any or all of the location of the cut 65, the length of the cut 65, the width of the corner flange 50, and/or the angle of the fold line 63 and the cut 65, can change the height of the cut 65 above the bottom of the erected container. This can permit adjustment of the liquid depth that can be held in the container according to end user specifications. In other examples such as FIGS. 9 and 10, the web can comprise a fold line with a small number of perforations instead of a longer cut, and the perforation(s) can be offset upwardly toward the fold line 55. In yet other examples, the fold line 63 can be one continuous fold line without the cut 65. In such examples, the liquid depth that can be held in the container can be determined by the height of the free edge 71 of the web 64 in the erected container.

Figure 5:
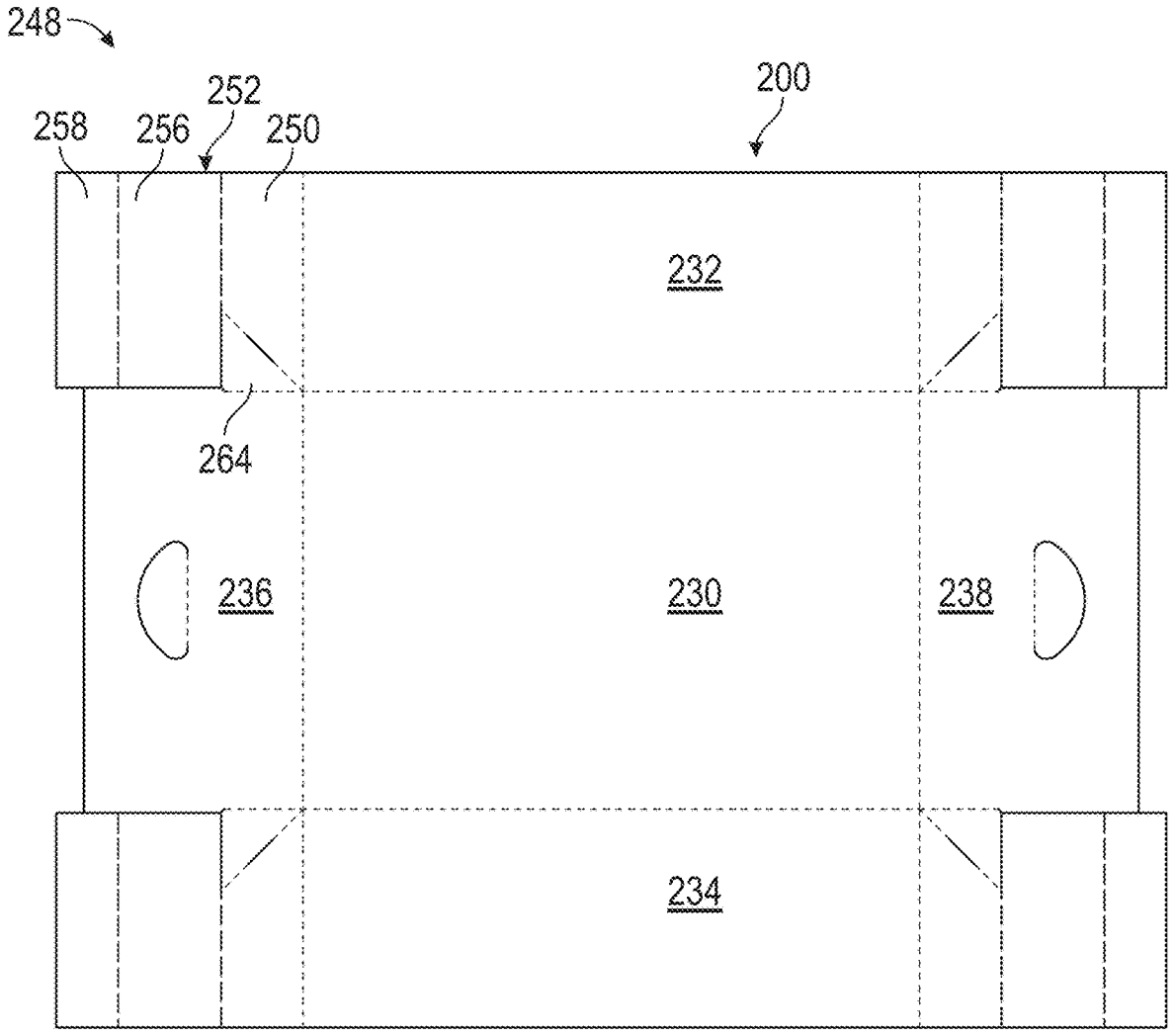
FIG. 5 illustrates a blank for a container including another example of a leak-resistant corner post.
Figure 6:
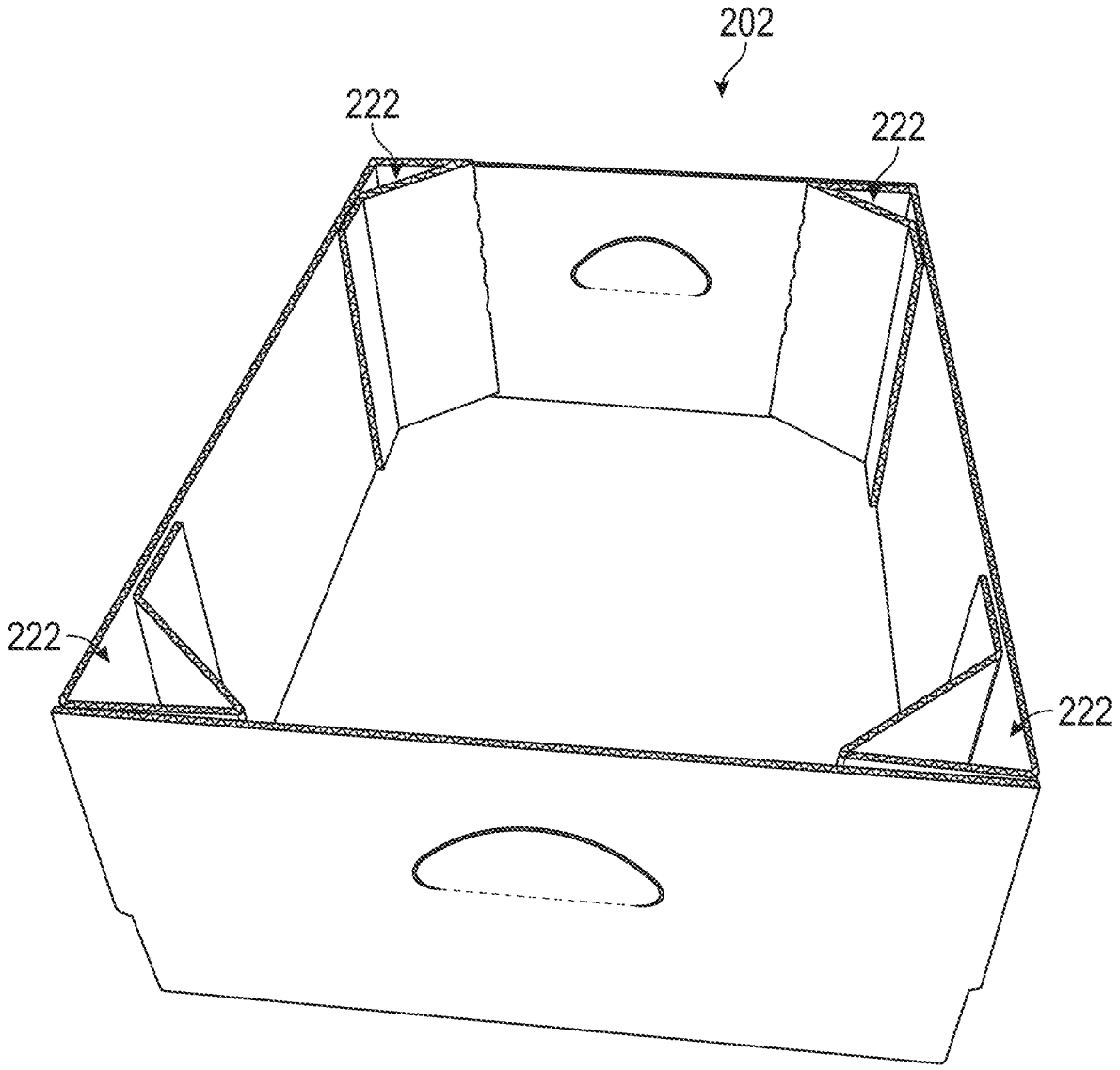
FIG. 6 illustrates a container erected from the blank of FIG. 5.

The configuration of the reinforced corner portions 48 can also be adapted to provide a variety of corner structures to suit particular end user specifications. For example, FIG. 5 illustrates another example of a blank 200 similar to the blank 100 but in which the reinforcement flap 252 includes two panels 256 and 258 instead of three panels as in FIG. 2. Features in FIG. 5 are similar to those with similar reference numbers in the prior examples. FIG. 6 illustrates a container 202 erected from the blank 200. The "corner post" structures of the containers 10 and 202 can provide stacking strength, and can also allow the containers to be made from a reduced thickness corrugated board while maintaining a specified strength.

Figure 7:
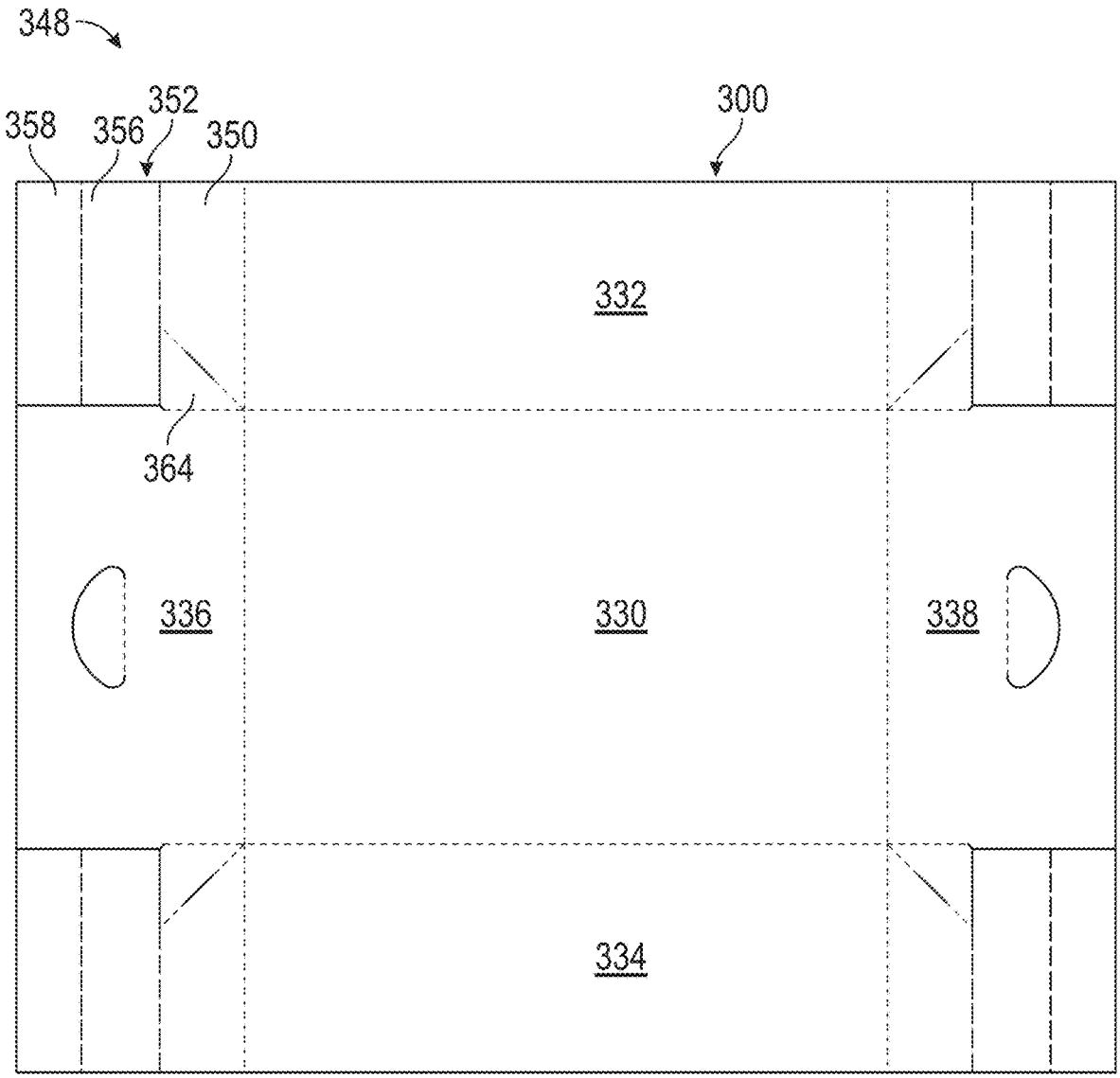
FIG. 7 illustrates a blank for a container including another example of a leak-resistant reinforced corner structure.
Figure 8:
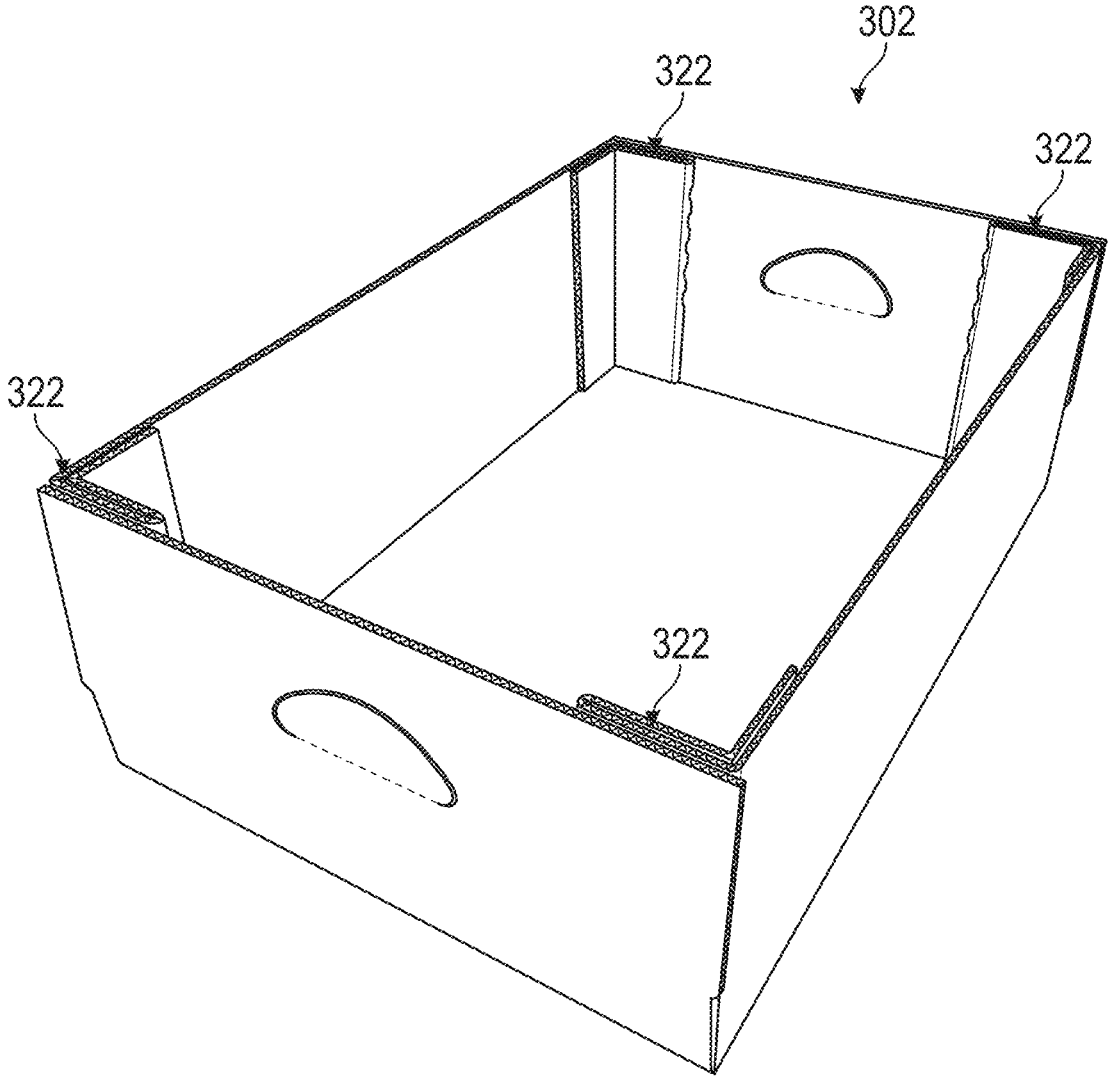
FIG. 8 illustrates a container erected from the blank of FIG. 7.

FIG. 7 illustrates another example of a blank 300 including reinforced corner structures 348 similar to the blank 100 but in which the reinforcement flaps 350 include two panels 356 and 358 sized to be tucked into the corners against the respective side wall panels and end wall panels. FIG. 8 illustrates a container 302 erected from the blank 300 including "L-shaped" reinforced corner structures 322 (also referred to as "double L" corners). The reinforced corner structures 322 of FIGS. 7 and 8 can be preferred for applications that specify greater interior volume than can be provided with corner posts. As in the previous examples, the web 364 provides leak resistance.

Other reinforced corner structures that can be included on the containers described herein include square corner posts, rectangular corner posts, right triangle corner posts (e.g., as shown in FIGS. 1-4), isosceles triangle corner posts (e.g., in which the reinforcement flaps 52 form an angle other than 450 with the container walls, such as 30° or 60°), trapezoidal corner posts, and/or parallelogram corner posts. Any of the reinforced corner structures described herein can include webs similar to the web 64.

Figure 9:
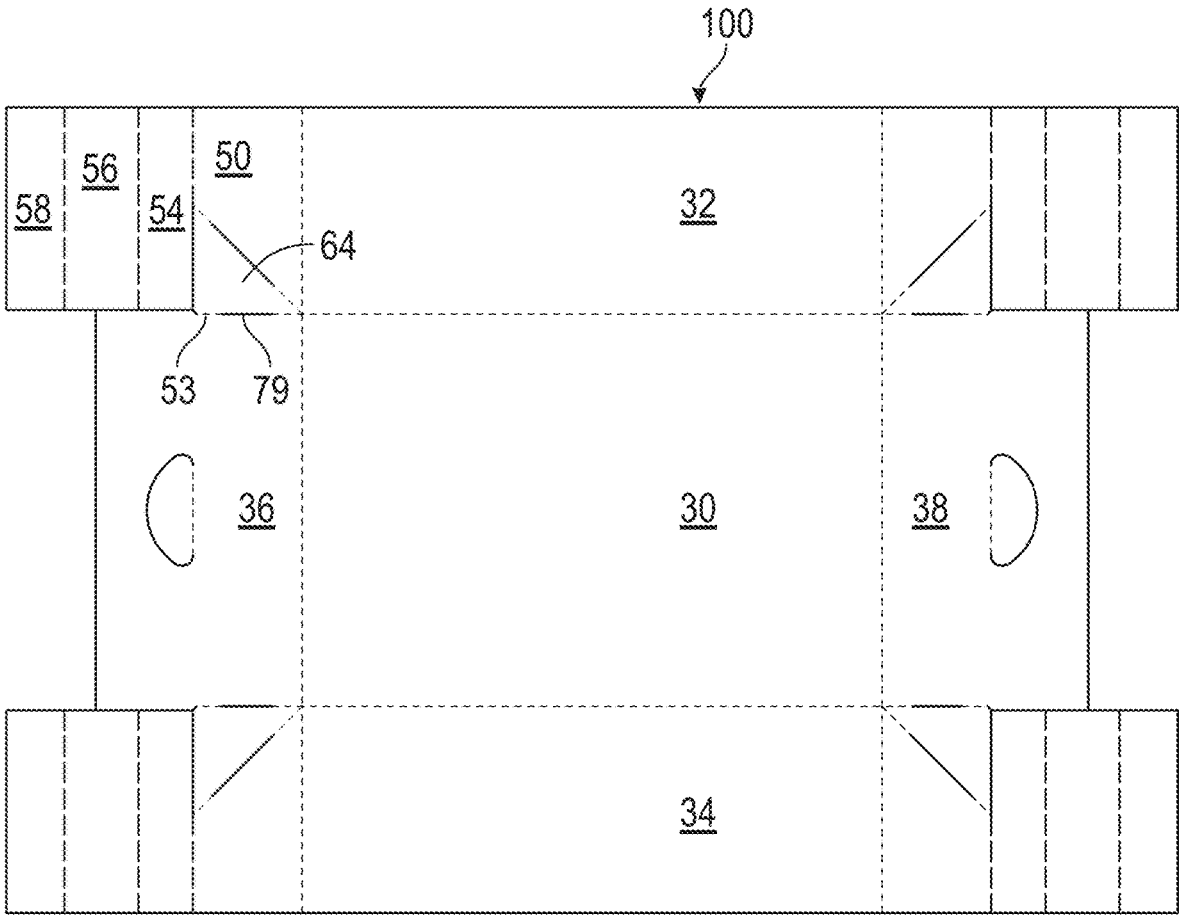
FIG. 9 illustrates another example of the blank of FIG. 2 wherein the fold line connecting the web and the first end wall panel comprises a relief cut.

FIG. 9 illustrates another configuration of the blank 100 in which the fold line 53 between the web 64 and the first end wall panel 36 includes a collinear cut 79. In the illustrated example, the cut 79 extends along a portion of the length of the fold line 53 so that the web 64 remains connected to the first end wall panel 36 on both sides of the cut 79. Any or all of the fold lines 53 and/or any of the other fold lines of the container blank 100 can include a cut such as the cut 79 for additional folding relief. Such "relief" cuts can aid in erecting the container, for example when the container is made from relatively thick or stiff materials.

Example 2: Leak-Resistant Containers with Reinforced Corners and Top Flaps

Figure 10:
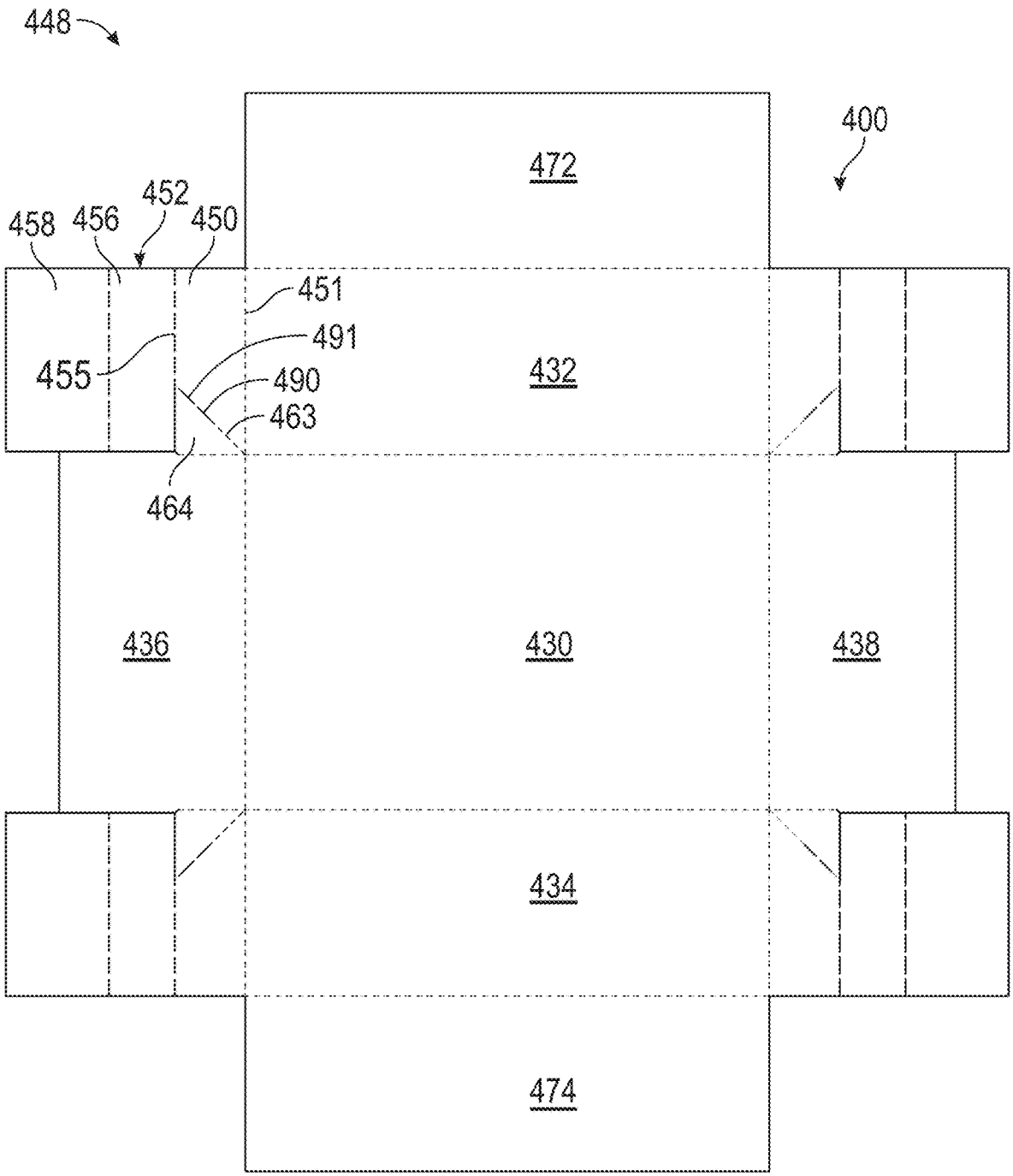
FIG. 10 illustrates a blank for another example of a container including leak-resistant reinforced corners and top flaps.

Any of the containers described herein can be provided with covers or lids. The covers can be separate, or can be integral with the container body in the form of top flaps. FIG. 10 illustrates another example of a blank 400 that is similar to the blank 200, but which includes top flaps. A top flap 472 is coupled to the first side wall flap 432, and a second top flap 474 is coupled to the second side wall flap 434. In the erected state, the top flaps 472 and 474 can be folded over the top opening of the container to close the container.

As noted above, the diagonal fold line of the web can include one or more perforations instead of a longer cut as in FIG. 2. For example, in FIG. 10 the web 464 comprises two relatively short perforations 490 and 491 on the fold line 463. The perforations 490 and 491 are located closer to the fold line 455 than to the fold line 451 (e.g., the perforations 490 and 491 are offset toward the fold line 455). This increases the height of the lower perforation 490 above the bottom of the container in the erected state, increasing the depth of liquid that can be held inside the container. Perforations similar to the perforations 490 and 491 can be implemented on any of the containers described herein.

Figure 11:
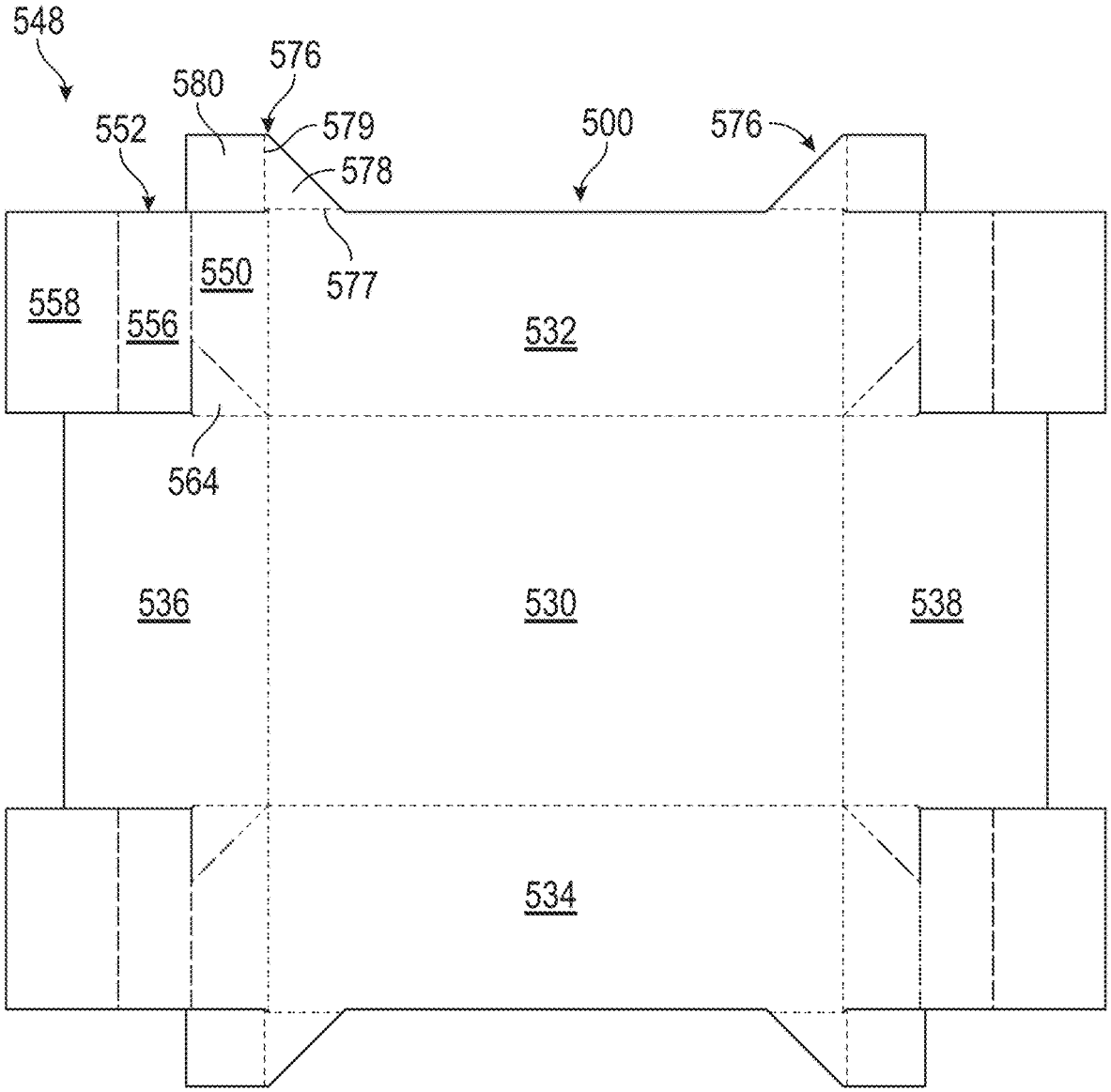
FIG. 11 illustrates a blank for another example of a container including leak-resistant reinforced corners and top flanges at the corners.
Figure 12:
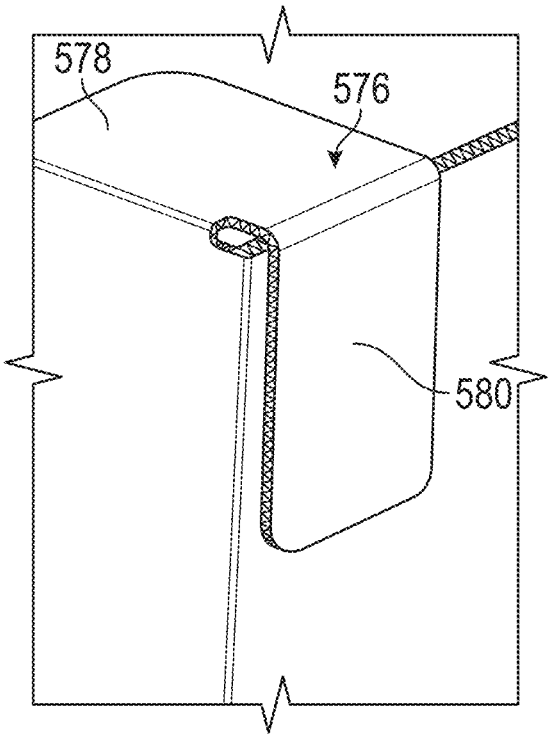
FIG. 12 is a perspective view of a portion of a container erected from the blank of FIG. 11 illustrating a top flange.

FIG. 11 illustrates another example of a blank 500 that includes a set of top flanges 576. Referring to the top flange 576 at the upper left of the blank 500 for reference, the top flange 576 is coupled to the first side wall panel 532 at a fold line 577. A fold line 579 divides the top flange 576 into a first panel 578 and a second panel 580. When the container is erected, the top flanges 576 can be folded down over the container opening about the fold line 577. The second panel 580 can then be folded over and adhered to the exterior surface of the corresponding side wall panel as shown in FIG. 12. This structure can enhance the stacking strength and stability of the container.

In certain examples any of the fold lines of the containers and covers described herein can include scores and/or perforations instead of or in addition to creases, as described above.

In certain examples, the containers and/or covers described herein can comprise any of various coatings on the interior and/or exterior surfaces to impart particular properties. For example, the containers and/or covers can include anti-abrasive coatings (e.g., polytetrafluorethylene (PTFE)), hydrophobic or water-repellant coatings, and/or antistatic coatings to reduce the buildup of electric charge. For example, the interior surfaces of the container can include any of a liquid-resistant inner paper liner, a water-resistant coating, an oil-resistant coating, and/or other types of fluid or viscous resistant inner surface treatments. Any of the coatings and treatments described herein can be combined in various layers and/or mixtures according to the particular properties sought, or as specified for a particular application.

Any of the features of the container examples above can be incorporated into any of the other container examples described herein. For example, the webs of the reinforced corner structures can include elongated cuts as in FIG. 2 or perforations as in FIGS. 10 and 11. Any of the example containers described herein can include any of the top flap configurations shown in FIGS. 10-12. A single container can also include different reinforced corner configurations at one or more of the corners. For example, a container can include a corner post in one or more corners and an L-shaped corner in one or more corners.

In the above description, features with corresponding reference numbers, such as reinforced corners 48, 248, 348, etc., are generally similar to those with similar reference numbers in other examples.

In addition to the advantages discussed above, additional advantages of crushed flutes in the webs 64 include secure and fast glue adhesion between the various panels in forming machinery, as well as a durable bond that resists popping open during use. Crushed flutes in the webs can also minimize the outer length or width dimension of the assembled container for a more efficient pallet fit.

As noted above, the end wall panel—reinforcement flap cut 60 and the fold line 53 are offset from each other along the y-axis and a short relief cut 69 extends from the junction of the cut 60 and the cut 61 to the fold line 53 at an angle to the x-axis. Thus, the end wall panel—reinforcement flap cut 60 and the fold line 53 (e.g., the first fold line) are not collinear. This can improve the stacking strength of the container by facilitating vertical side walls in the assembled container and preventing the side walls and/or the end walls from canting outward in the assembled state.

Additionally, as shown in FIGS. 2, 5, 9, 10, and 11, in some examples the reinforcement flaps (e.g., flap 52 in FIG. 2) can extend outwardly beyond the edges of the end wall flaps (e.g., the end wall flap 36 in FIG. 2) and/or outwardly of the side wall flaps (e.g., side wall flap 32). This can facilitate the creation of a wide range of reinforced corner "corner post" sizes and shapes.

In view of the many possible embodiments to which the principles of the disclosed technology may be applied, it should be recognized that the illustrated embodiments are only preferred examples and should not be taken as limiting the scope of the disclosure. Rather, the scope of the disclosure is at least as broad as the following claims and equivalents of the recited features. We therefore claim all that comes within the scope and spirit of these claims.

The invention claimed is:

1. A container, comprising:

a bottom panel forming a container bottom;

a first side wall panel coupled to the bottom panel and forming a first side wall of the container;

a second side wall panel coupled to the bottom panel and forming a second side wall of the container;

a first end wall panel coupled to the bottom panel and forming a first end wall of the container;

a second end wall panel coupled to the bottom panel and forming a second end wall of the container; and a reinforced corner structure comprising a corner flange coupled to the first side wall panel and to the first end wall panel by a triangular web of the corner flange;

wherein the triangular web is coupled to the first end wall panel along a first fold line and coupled to the corner flange along a second fold line, and wherein the triangular web is positioned between the first end wall panel and the corner flange when the container is in an erected state;

wherein the reinforced corner structure further comprises a reinforcement flap coupled to the corner flange along a third fold line;

wherein the second fold line intersects the third fold line to define a corner of the triangular web at a location along the third fold line that is inward from an outer edge of the reinforcement flap such that the triangular web is formed at a lower corner of the corner flange; and wherein the container comprises a corrugated paperboard material, and flutes of the corrugated paperboard material are crushed in the triangular web.

2. The container of claim 1, wherein the corner flange further comprises a cut or perforation that is above the container bottom and collinear with the second fold line.

3. The container of claim 2, wherein the reinforced corner structure is free of cuts in the corrugated paperboard material up to a level of the cut or perforation that is collinear with the second fold line.

4. The container of claim 1, wherein the triangular web comprises a free upper edge that is located between the first end wall panel and the corner flange.

5. The container of claim 4, wherein the free upper edge of the web is located below a rim of the container and between the first end wall panel and the corner flange, and the free upper edge is oriented upwardly toward an opening of the container.

6. The container of claim 4, wherein the free upper edge of the web is defined by a cut that is collinear with the third fold line.

7. The container of claim 1, wherein the reinforcement flap comprises two reinforcement panels or three reinforcement panels.

8. The container of claim 1, wherein the reinforcement flap is adhered to the corner flange above the triangular web and the corner flange is free of adhesive below a free upper edge of the triangular web.

9. The container of claim 1, further comprising a first top flap coupled to the first side wall panel and a second top flap coupled to the second side wall panel.

10. The container of claim 1, wherein the first fold line comprises a relief cut.

11. The container of claim 1, wherein the second fold line of the triangular web extends diagonally across the corner flange at an angle to the first fold line of 30° to 60°.

12. The container of claim 1, wherein an end wall panel—reinforcement flap cut separates the first end wall panel from the reinforcement flap, and the first fold line coupling the triangular web to the first end wall panel and the end wall panel—reinforcement flap cut are offset from each other such that the first fold line and the end wall panel—reinforcement flap cut are not co-linear.

13. A container blank, comprising:

a bottom panel for forming a container bottom;

a first side wall panel coupled to the bottom panel;

a second side wall panel coupled to the bottom panel on the opposite side of the bottom panel from the first side wall panel;

a first end wall panel coupled to the bottom panel;

a second end wall panel coupled to the bottom panel on the opposite side of the bottom panel from the first end wall panel;

a reinforced corner structure comprising a corner flange coupled to the first side wall panel and to the first end wall panel by a web of the corner flange;

wherein the web is coupled to the first end wall panel along a first fold line and coupled to the corner flange along a second fold line;

wherein the reinforced corner structure further comprises a reinforcement flap coupled to the corner flange along a third fold line, and the reinforcement flap comprises a cut that is collinear with the third fold line, the cut defining a free edge of the web;

wherein the web is positionable between the first end wall panel and the corner flange when the container blank is erected into a container such that the free edge of the web is located between the reinforcement flap and the corner flange; and wherein the container blank comprises a corrugated paperboard material, and flutes of the corrugated paperboard material are crushed in the web.

14. The container blank of claim 13, wherein the corner flange further comprises a cut or perforation that is collinear with the second fold line.

15. The container blank of claim 14, wherein the cut or perforation is spaced apart from the first fold line in a direction of flutes of the corrugated paperboard material.

16. The container blank of claim 13, wherein the reinforcement flap comprises two reinforcement panels or three reinforcement panels.

17. The container blank of claim 13, wherein an end wall panel—reinforcement flap cut separates the first end wall panel from the reinforcement flap, and the first fold line coupling the web to the first end wall panel and the end wall panel—reinforcement flap cut are offset from each other such that the first fold line and the end wall panel—reinforcement flap cut are not collinear.

18. The container blank of claim 13, wherein the reinforcement flap extends outwardly beyond the first end wall panel.

19. The container blank of claim 13, further comprising a first top flap coupled to the first side wall panel and a second top flap coupled to the second side wall panel.

20. The container blank of claim 13, wherein the second fold line of the web extends diagonally across the corner flange at an angle to the first fold line of 30° to 60°.

21. The container blank of claim 13, wherein the second fold line intersects the third fold line to define a corner of the web at a location along the third fold line that is inward from an outer edge of the reinforcement flap such that the web is formed at a lower corner of the corner flange.

22. A container blank, comprising:

a bottom panel for forming a container bottom;

a first side wall panel coupled to the bottom panel;

a second side wall panel coupled to the bottom panel on the opposite side of the bottom panel from the first side wall panel;

a first end wall panel coupled to the bottom panel;

a second end wall panel coupled to the bottom panel on the opposite side of the bottom panel from the first end wall panel;

a reinforced corner structure comprising a corner flange coupled to the first side wall panel and to the first end wall panel by a web of the corner flange, the reinforced corner structure further comprising a reinforcement flap coupled to the corner flange such that the corner flange is between the first side wall panel and the reinforcement flap;

wherein the web is coupled to the first end wall panel along a first fold line and coupled to the corner flange along a second fold line, and wherein the web is positionable between the first end wall panel and the corner flange when the container blank is erected into a container; and wherein an end wall panel—reinforcement flap cut separates the first end wall panel from the reinforcement flap, and the first fold line and the end wall panel—reinforcement flap cut are offset from each other such that the first fold line and the end wall panel—reinforcement flap cut are not collinear.

23. The container blank of claim 22, wherein the web comprises a free edge that is located between the reinforcement flap and the corner flange, the free edge of the web being defined by a cut, and the reinforcement flap comprising a third fold line that is collinear with the cut defining the free edge.

24. The container blank of claim 22, wherein the reinforcement flap extends outwardly beyond the first end wall panel.

25. A container, comprising:

a bottom panel forming a container bottom;

a first side wall panel coupled to the bottom panel and forming a first side wall of the container;

a second side wall panel coupled to the bottom panel and forming a second side wall of the container;

a first end wall panel coupled to the bottom panel and forming a first end wall of the container;

a second end wall panel coupled to the bottom panel and forming a second end wall of the container; and a reinforced corner structure comprising a corner flange coupled to the first side wall panel and to the first end wall panel by a web of the corner flange;

wherein the web is coupled to the first end wall panel along a first fold line and coupled to the corner flange along a second fold line, and wherein the web is positioned between the first end wall panel and the corner flange when the container is in an erected state;

wherein the reinforced corner structure further comprises a reinforcement flap coupled to the corner flange along a third fold line;

wherein the container comprises a corrugated paperboard material, and flutes of the corrugated paperboard material are crushed in the web; and wherein the reinforcement flap is adhered to the corner flange above the web and the corner flange is free of adhesive below a free upper edge of the web.

* * * * *